US005416247A

United States Patent [19]

Webster

[11] Patent Number: 5,416,247

[45] Date of Patent: May 16, 1995

[54] CHEMICAL DISPOSAL OF HALOCARBONS

[75] Inventor: James L. Webster, Parkersburg, W. Va.

[73] Assignee: E. I. Du Pont de Nemours and Company, Wilmington, Del.

[21] Appl. No.: 155,357

[22] Filed: Nov. 19, 1993

[51] Int. Cl.[6] ..... A63D 3/00

[52] U.S. Cl. ..... 588/206; 588/210

[58] Field of Search ..... 588/206, 210

[56] References Cited

U.S. PATENT DOCUMENTS

| | | | |
|---|---|---|---|
| 3,845,191 | 10/1974 | Bruce, Jr. | 423/240 R |
| 4,410,402 | 10/1983 | Sawyer et al. | 204/59 R |
| 5,114,692 | 5/1992 | Berty | 423/245.3 |
| 5,176,897 | 1/1993 | Lester | 423/659 |
| 5,265,443 | 11/1993 | Yuzawa et al. | 62/498 |

OTHER PUBLICATIONS

Ad-Hoc Technical Advisory Committee on ODS Destruction Technologies, United Nations Environment Programme, pp. 29–45, May 1992.

*Primary Examiner*—Gary P. Straub
*Attorney, Agent, or Firm*—Edwin Tocker

[57] ABSTRACT

Halogen-containing organic compounds are reacted with alkali metal or earth alkaline metal carbonate and/or oxide to convert the halogen component of the compound to halide of the metal, thus converting a liquid or gaseous compound to a solid halogen-containing compound for use or safe landfill disposal.

12 Claims, No Drawings

CHEMICAL DISPOSAL OF HALOCARBONS

FIELD OF THE INVENTION

This invention relates to a method for the destruction of various halogen-containing organic gases and liquids.

BACKGROUND OF THE INVENTION

Halogen-containing organic compounds are difficult to destroy in an environmentally friendly manner. While incineration will destroy the compounds, incineration usually forms halogen acids which in themselves are difficult to remediate. The United Nations Enviromental Programme issued a report entitled, "AD-HOC TECHNICAL ADVISORY COMMITTEE ON ODS DESTRUCTION TECHNOLOGIES," in May, 1992 that reviewed non-incineration technologies for halocarbon disposal. One process was the addition of chlorofluorcarbons or chlorocarbons to the cement manufacturing process. Such chlorine-containing compounds were only added at low levels so that the amount of chlorine or fluorine present in the resultant cement was only a very small percentage of the total weight of the cement, and cement kilns are very large scale processes that produce a mixed product that is eventually reacted with water. Another technology discussed was the reaction of halocarbons with aluminum oxide at 500°-800° C. to form $AlCl_3$ and $AlF_3$, along with $CO_2$. These two products have disadvantages in that $AlCl_3$ can violently react with water and $AlF_3$ has a significant solubility in water, i.e., 0.56 g will dissolve in 100 cc of water at 25° C. A third technology discussed by the UN document was the reaction of higher chlorinated hydrocarbons with calcium silicate or calcium oxide at 700° C. The formed products are then reacted with superheated steam to generate haloacids and regenerate the original salts. The temperature of this process is far below that required to decompose many of the halocarbons, particularly perfluorocarbons. The silicate reaction would be expected to also lead to some formation of $SiF_4$, a compound more difficult to handle in an environmentally friendly manner.

SUMMARY OF THE INVENTION

The present invention involves the discovery of a process which allows the simple and safe disposal of halogen-containing organic compounds, in an environmentally friendly manner and either on small or large scale. More specifically, the present invention comprises the process for converting halogen-containing organic compound to environmentally friendly product, comprising contacting and reacting said compound with reactant which is at least one carbonate or oxide of a metal selected from the group consisting of alkali metal and alkaline earth metal at temperature, which is at least the threshold temperature for the reaction, and for a contact time which is effective to convert at least a substantial proportion of the halogen component of said compound to halide of said metal.

This process converts halogen-containing organic compounds which are normally gas at ambient temperature, but may also be liquid, to solid metal halides. Preferably these solid metal halides are insoluble in water, e.g. less than 0.1 g of the halide will dissolve in 100 cc of water at 25° C., and preferably less that 0.01 g of the halide will so dissolve. The halide can be used as such or in the case of insoluble halides can be safely landfilled because of the low water solubility. For this reason, the process of the present invention can be considered as chemical disposal of these organic compounds.

DETAILED DESCRIPTION

The following terminology is used herein. Halogen-containing organic compounds in general are called halocarbons, or designated by HC. The halogen-containing organic compounds are divided into three classes with codes as follows:

PFC=organic perfluorocarbons, e.g. $CF_3—CF_3$

HFC=hydrogen-containing organic fluorocarbons, e.g. $CF_3—CF_2H$

OHOC=all other halogenated organic compounds, e.g. $CF_2Cl—CHBr_2$

The process of this invention involves reacting gaseous HC with alkaline earth or alkaline metal oxides or carbonates at temperatures over 500° C. Because of its low cost and availability, and the insolutibility of the reaction products formed, calcium carbonate is a preferred starting reactant. As calcium carbonate is heated above 500° C., which is the threshold reaction temperature for some of the compounds treated by chemical disposal in accordance with the present invention, carbon dioxide is driven off as shown by the reaction below:

$$CaCO_3 \rightarrow CaO + CO_2$$

The higher the temperature, the more rapidly the $CO_2$ is driven off. By 898° C., the dissociation pressure of $CO_2$ is 760 mmHg. If, for example, PFC is passed over the hot $CaCO_3$ or CaO, calcium fluoride and additional $CO_2$ or CO are formed. This is illustrated by $$3CaO + CF_3—CF_3 \rightarrow 3CaF_2 + CO_2 + CO \quad (1)$$

For HFC, for example, $$5CaO + 2CF_3—CF_2H \rightarrow 5CaF_2 + H_2O + 2CO_2 \quad (2)$$

For OHOC, for example, $$5CaO + 2CF_2Cl—CHBr_2 \rightarrow 2CaF_2 + CaCl_2 + 2CaBr_2 + H_2O + 2CO_2 \quad (3)$$

In practice, the above reactions would generally also yield some level of CO because of non-equilibrium conditions throughout the reactor bed. In any case, when CO is a reaction product, then an additional process step of the present invention would be to react oxygen, such as supplied by air, with the CO to form $CO_2$ either during the reaction [equation (1), (2) or (3)] or thereafter.

With the possible exception of any formed CO, the reaction products from CaO or $CaCO_3$ with the PFC or HFC are generally considered environmentally acceptable since $CaF_2$ has very low water solubility, 0.0016 g/100 cc of water at 25° C., $CO_2$ is recycled back to carbon and oxygen by vegetation, and water is benign.

OHOC, when reacted with CaO or $CaCO_3$, can form other calcium salts in addition to those from PFC or HFC. These other calcium salts generally have lower melting points and are more water soluble, and thus can have a greater chance for deleterious environmental effects. However, these other salts can be selectively recovered and used in a variety of applications. Nevertheless, organic compounds which are perfluorocarbon or which are hydrofluorocarbons, i.e., chlorine-free, are the preferred compounds subjected to chemical disposal in accordance with the process of the present invention.

The illustrative reactions described above can work as effectively with other alkaline (alkali metal and alkaline earth, i.e., the elements of Group IA and IIA of the Periodic Table) oxides or carbonates as reactants, such as the oxides or carbonates of Na, K, Mg, and Ba. But because of the generally lower melting points and increased water solubility of the other alkaline halogen salts, this may only be an advantage when the halide is to be re-used rather than landfilled. More than one alkaline metal carbonate and/or oxide can be present during the reaction.

Operation of this process at or near atmospheric pressure has the advantages of simplicity of operation and minimal investment, but the process will work well under most practical pressures. The principle of La-Chatelier-Braun would suggest some slight improvement in operation at sub-ambient pressures. The reactor used to practice the chemical disposal process of the present invention can be of any design suitable for gas phase reactions, including fixed bed reactors, fluid bed reactors, plasma reactors, etc.

Generally, the gaseous organic compound will be flowed through a bed of the reactant at a temperature which is at least the threshold reaction temperature for the particular organic compound and for a contact time which are effective, i.e., which will cause at least 50% of the organic compound to be consumed in the reaction. Preferably, at least 90% and more preferably, at least 95% of the organic compound is consumed, such that at least the corresponding proportion of halogen component ends up as metal halide. The Examples show different threshold temperatures for different compounds, these temperatures being the temperatures that should be reached or exceeded so as to cause the halide-forming reaction within a reasonable time, e.g. 0.01 to 500 seconds contact time, preferably 0.01 to 200 seconds. For hydrofluorocarbons such as pentafluoropropane, the threshold temperature is about 500° C., whereas for tetrafluoromethane, the threshold temperature is about 900° C. Preferably, the reaction will be carried out at a higher temperature than the theshold temperature, so that a shorter contact time and more complete reaction will occur. From the Examples, it will be seen that perfluorocarbons require the highest temperatures for this chemical disposal, with the needed reaction temperature decreasing as the overall chain length of the compound increases (overall carbon count) and with the threshold temperature generally being at least 875° C. The similar reaction of hydrofluorocarbons occurs at lower temperatures than for perfluorocarbons of equivalent chain length. Likewise, for compounds containing any halogen other than fluorine, temperatures generally lower than those required for perfluorocarbons of equivalent chain length can be used. The highest temperature used, to minimize contact times, is generally limited only by the reactor materials or design and the desired condition of the metal halide reaction product, e.g. it is desired that the metal halide not melt, whereby in the case of $CaF_2$, the reaction temperature should be kept below its melting temperature of 1423° C.

The reaction between the organic compound and reactant bed will generally be carried out until substantially all of the the bed in the reaction zone, i.e., the zone where the temperature is at least the threshold temperature, is converted to halide of the metal carbonate and/or oxide forming the bed.

The following examples show some of the halocarbons and reactants that can be used for chemical disposal of the halocarbons.

EXAMPLE 1

A 0.5-inch (1.3-cm) diameter tube, 16 inches (40.6 cm) long, made from Inconel® 600 (The International Nickel Company) was packed full with 45 g of crushed limestone rock (<7 mesh, >10 mesh) and placed in a 12-inch-long split shell furnace. Gas flows to this reactor were monitored by valve controlled rotameters and the product gases were analyzed by gas chromatographic analysis and reported as area percents which approximate volume percents. The reactor temperature was monitored by an external thermocouple located two inches down stream from the middle of the reactor, and it was assumed that the middle 4 inches of the reactor were at the maximum recorded temperature. The reactor was heated to 950° C. with a nitrogen sweep to drive off part of the $CO_2$ from the calcium carbonate. The temperature was reduced to 850° C., the nitrogen was turned off, and a gas flow of 12 cc (cubic centimeters)/min of perfluoroethane was started. There was an almost immediate breakthrough in the exit stream of the PFC. Carbon monoxide was also present, indicating some level of decomposition of the $C_2F_6$. The PFC flow was stopped and the nitrogen flow was restarted as the temperature was increased to 900° C. The perfluoroethane flow was restarted and this time there was only CO and $CO_2$ in the exit stream indicating complete conversion of the perfluoroethane, with formation of calcium fluoride from the halogen component of the PFC. Based on the middle 4 inches of the reactor, the gas contact time was about 12 sec. These conditions and results were maintained for about 25 min, then the flow was increased to 21 cc/min for a 7 sec gas contact time. A gas analysis taken 7 minutes later showed, in addition to the CO and $CO_2$, 0.7% $CF_4$ and 0.9% $C_2F_6$. Over the next 20 minutes the temperature increased fairly rapidly without additonal heat input, reaching 990° C., indicating that the reaction front had reached the thermocouple. During this period of rapid temperature rise, the perfluoroethane breakthrough became significant, going from 4% to 8% to 22% in samples of the outlet stream taken at successive 5 minute intervals. When the reactor was cooled and opened, the first inch of material within the furnace at the inlet end was the gray color of the limestone. The next two inches of material were pure white, tested basic, and were calcium oxide. The next four inches of material were brown to greenish brown and when the material was placed in water, it gave a pH of 7, indicating it was calcium fluoride, with a trace of nickel fluoride (green and soluble) attributable to nickel from the reactor walls. The colors reversed toward the exit end of the reactor, but a trace of carbon was also seen. When the middle portion of the removed bed (brown to greenish brown) was ground to a powder, there was no indication of calcium oxide, leading to the conclusion that the reaction was not just a surface reaction but penetrated the entire carbonate/oxide particle, thereby converting substantially the entire bed of carbonate/oxide in the reaction zone in the reactor to $CaF_2$ It is estimated that a third of the bed, about 15 g, the brown to greenish brown portion, had been reacted.

EXAMPLE 2

The experiment of Example 1 was repeated except that the entire process was conducted with temperature control set at 950° C. After the PFC had been on line for 70 minutes at the flow rate of 12 cc/min, 0.06% $CF_4$ was detected in the outlet gas stream. After 105 minutes, the $CF_4$ level was 0.8%, with no perfluoroethane breakthrough. After 115 minutes, the gas chromatograph showed 31% perfluoroethane and 0.7% $CF_4$, with the temperature increasing fairly rapidly without heat input. Before the perfluoroethane breakthrough, 1070 cc of PFC gas had been fed to the reactor. A material balance shows that this flow would account for 14.3 g of the calcium carbonate (out of 45 g) so the ⅓ estimate of bed utilization in Example 1 was very close. This probably indicates what portion of the bed was actually at reaction temperature. A more efficiently designed furnace should give much higher bed utilizations. Importantly, it can be concluded that this is an efficient process for perfluoroethane destruction at 950° C.

EXAMPLE 3

Example 1 was repeated except that a small stream of air was added to the inlet flow to see if the oxygen would allow the reaction to proceed at lower temperature. However, it still required a temperature of about 950° C. to drive the reaction and again, near the end of the run there was a temperature spike. There did appear to be a slight reduction in the amount of CO generated, as would be expected.

EXAMPLE 4

The equipment and procedures used were similar to those of Example 1, but perfluoromethane was used as the feed gas and different temperature profile was followed. The temperature set point started at 950° C. was slowly raised. The amount of $CF_4$ in the exit gas varied with temperature as shown by the following data:

| T (° C.) | $CF_4$ (area %) |
|---|---|
| 950 | 38.1 |
| 990 | 18.7 |
| 1030 | 5.1 |
| 1060 | 1.0 |
| 1085 | 0.04 |
| 1100 | none |
| 1060 | 2.9 |

Thus, about 150° C. higher temperatures were required to destroy $CF_4$, when compared to the destruction of $C_2F_6$ in Examples 1 and 2.

EXAMPLE 5

With conditions and equipment similar to Example 1, pentafluoroethane was fed to the reactor to determine the temperature at which significant decomposition first occurred (the intiation temperature). The gaseous feed rate of the HFC was 30 cc/min, giving about a 5-sec gas contact time. The temperatures and concentrations of $C_2F_5H$ in the exit flow on a water-free basis are shown below:

| T (° C.) | $C_2F_5H$ (area %) |
|---|---|
| 355 | 85.7 |
| 395 | 86.5 |

-continued

| T (° C.) | $C_2F_5H$ (area %) |
|---|---|
| 440 | 75.9 |
| 505 | 32.4 |
| 555 | 2.6 |

The data indicate that the threshold temperature for this HFC in this reaction at this contact time is about 500° C.

EXAMPLE 6

The procedure of Example 5 was repeated generally but with 0.12 cc/min of liquid water (about 16 cc/min of vapor) being added to the gaseous feed to see if it would promote the reaction:

| T (° C.) | $C_2F_5H$ (area %) |
|---|---|
| 515 | 73.9 |
| 535 | 30.2 |
| 580 | 16.4 |
| 665 | 7.5 |
| 710 | 2.6 |
| 740 | 0.8 |

Thus, the water vapor appeared to hinder the reaction, but this change may be due to the fact the gas contact time was only about 3 sec because the added water vapor increased the total flow rate. Improved conversions for these decomposition reactions can be obtained by using higher temperatures or longer contact times.

EXAMPLE 7

$CF_3H$ was fed to calcium carbonate, as in Example 1, at a flow of 8 cc/min (about 18 sec gas contact) and a temperature of 850° C. There was only 0.04% $CF_3H$ in the exit stream after 25 min of running.

EXAMPLE 8

When a $CF_2HCl$/nitrogen mixture was passed over sodium carbonate at 605° C., there was only 12% $CF_2HCl$ in the exit gases, along with 22% other fluorocarbons and 65% carbon dioxide. These results are reported on a nitrogen-free and water-free basis. CO levels were not measured.

What is claimed is:

1. Process for converting normally gaseous halogen-containing organic compound(s) to inorganic halide product(s), consisting essentially of contacting said compound(s) with reactant selected from the group consisting of alkali metal and alkaline earth metal carbonate(s) at a temperature and contact time which are effective to convert at least 90% of the halogen component of said compound(s) to halide of said metal, said temperature being at least 500° C. and said contact time being from 0.01 to 500 seconds.

2. The process of claim 1 wherein the compound(s) is a perfluorocarbon.

3. The process of claim 2 wherein said perfluorocarbon is perfluoromethane, perfluoroethane, or perfluoropropane and said temperature is at least 875° C.

4. The process of claim 1 wherein said compound(s) is a hydrofluorocarbon.

5. The process of claim 4 wherein said hydrofluorocarbon is pentafluoroethane and said temperature is at least 500° C.

6. The process of claim 1 wherein said compound contains chlorine.

7. The process of claim 1 wherein said reactant is calcium carbonate and is in the form of a bed and the reaction with said compound(s) is carried out by flowing said compound(s) through said bed.

8. The process of claim 1 wherein said reactant is alkaline earth metal carbonate, with the temperature of said reaction converting at least some of the said carbonate to alkaline earth metal oxide and wherein said compound(s) is reacted with said oxide to form halide of said alkaline earth metal.

9. The process of claim 8, wherein said alkaline earth metal carbonate is calcium carbonate.

10. The process of claim 1, wherein said compound(s) is a perfluorocarbon and said reactant is calcium carbonate.

11. The process of claim 1 and additionally reacting any carbon monoxide formed during the contacting of said compound(s) with said reactant with oxygen subsequent to said contacting step.

12. The process of claim 1 wherein said halide of said metal has a solubility of less than 0.1 g/100cc of water at 25° C.

* * * * *